US008256361B2

(12) United States Patent
Stiefel et al.

(10) Patent No.: US 8,256,361 B2
(45) Date of Patent: Sep. 4, 2012

(54) LIQUID-COOLED GRILL COMPRISING WEAR PLATES

(75) Inventors: Martin Stiefel, Ottikon (CH); Thomas Stiefel, Wetzikon (CH)

(73) Assignee: Doikos Investments Ltd., St. Helier, Jersey Channel Islands (GB)

( * ) Notice: Subject to any disclaimer, the term of this patent is extended or adjusted under 35 U.S.C. 154(b) by 966 days.

(21) Appl. No.: 12/282,337

(22) PCT Filed: Mar. 16, 2007

(86) PCT No.: PCT/CH2007/000143

§ 371 (c)(1),
(2), (4) Date: Sep. 9, 2008

(87) PCT Pub. No.: WO2007/107024

PCT Pub. Date: Sep. 27, 2007

(65) Prior Publication Data

US 2009/0101320 A1 Apr. 23, 2009

(30) Foreign Application Priority Data

Mar. 17, 2006 (CH) ..... 0410/06

(51) Int. Cl.
*F23H 3/00* (2006.01)
*F23K 3/00* (2006.01)

(52) U.S. Cl. ..... 110/298; 110/267

(58) Field of Classification Search ..... 110/298, 110/267, 268, 270, 271, 272, 300, 311, 312, 110/290, 291, 294, 208, 308; 257/712; 126/152 A, 126/173; 165/134.1, 136
See application file for complete search history.

(56) References Cited

U.S. PATENT DOCUMENTS

| | | | | | |
|---|---|---|---|---|---|
| 2,387,383 | A | * | 10/1945 | Bennett | 122/376 |
| 3,263,655 | A | * | 8/1966 | Robson, Jr. | 122/376 |
| 4,698,948 | A | * | 10/1987 | Yamashita et al. | 52/410 |
| 5,033,396 | A | * | 7/1991 | Pauli | 110/281 |
| 5,673,636 | A | * | 10/1997 | Stiefel | 110/346 |
| 5,743,197 | A | * | 4/1998 | Kinni et al. | 110/245 |
| 5,899,149 | A | * | 5/1999 | Binner et al. | 110/268 |
| 6,024,031 | A | * | 2/2000 | Stiefel | 110/281 |
| 6,347,661 | B2 | * | 2/2002 | Miki | 165/80.4 |

* cited by examiner

*Primary Examiner* — Kenneth Rinehart
*Assistant Examiner* — Timothy K Trieu
(74) *Attorney, Agent, or Firm* — CUSPA Technology Law Associates; Yi Li

(57) ABSTRACT

A grill consisting of liquid-cooled grill plates and liquid-cooled lateral panels, the surfaces of which are provided with wear plates (1) connected to the liquid-cooled grill plates (2) and lateral planks in a heat-conducting manner. Wear plates (1) consist of a wear-resistant material which must however be cooled. Advantageously, a layer of a heat-conducting material in the form of a highly heat-conducting soft silicon film (3) is clamped between the liquid-cooled grill plates (2) and lateral panels and the wear plates (1), the layer providing a good heat transfer between the wear plates (1) and the permeable grill plates (2) and central panels. It is thus ensured that, during operation, the wear plates (1) always remain in a non-critical temperature range as they are cooled by the underlying grill plates (2) and lateral panels which are cooled to ca. 50° C.

8 Claims, 6 Drawing Sheets

LIQUID-COOLED GRILL COMPRISING WEAR PLATES

Figure 1:
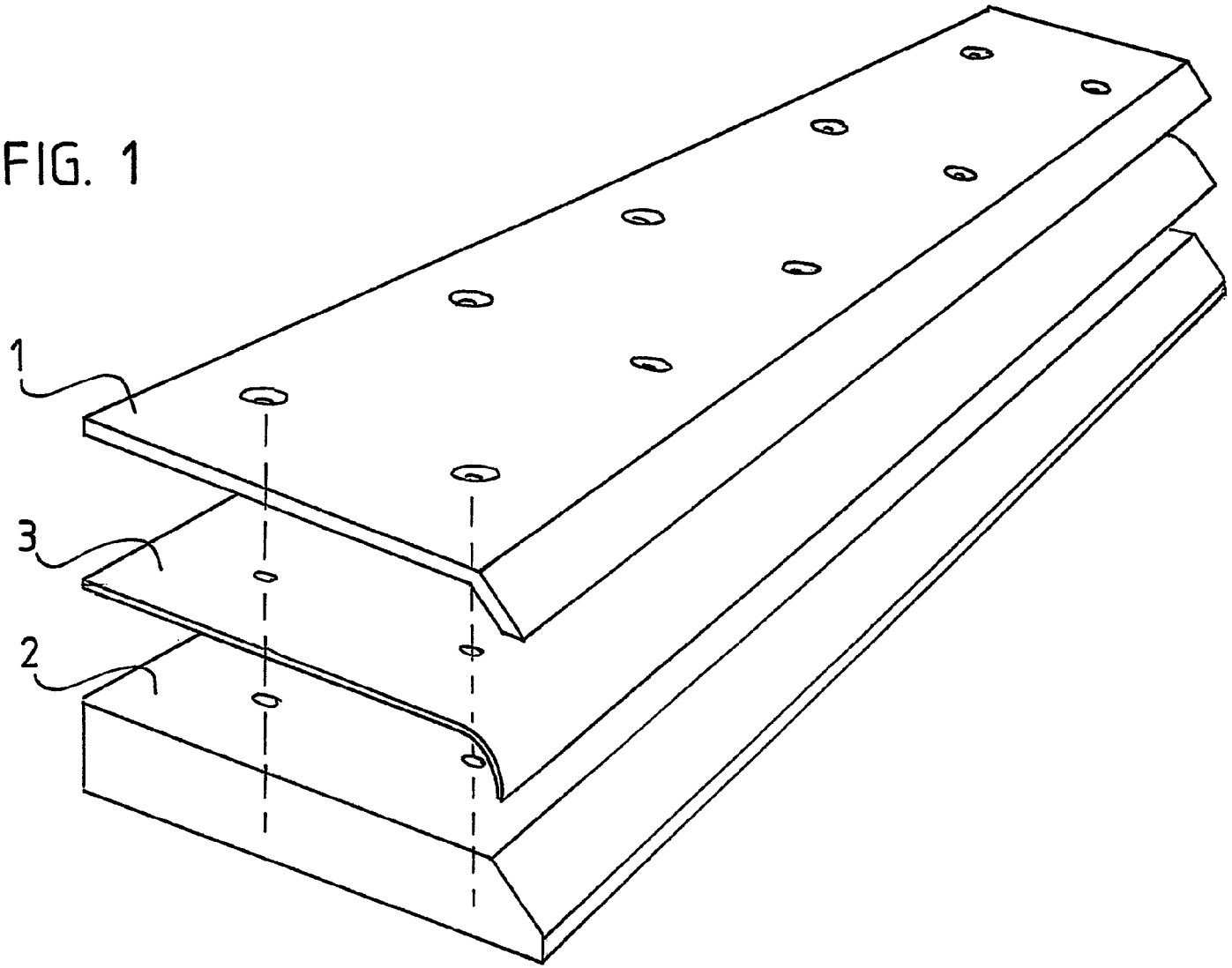

As shown in EP 0 621 449 for instance, the structure of a liquid-cooled grill/grate for household rubbish combustion/incineration has comprised to date water-cooled grill plates which are assembled to a grill in an overlapping, stair-shaped arrangement. Each grill plate level can be shifted forward and backward in the direction of the entire grill run in order to generate a stir-up and transport movement for the combustion material sitting on the grill.

Said liquid-cooled grill plates are made from steel of a thickness of approx. 10-12 mm, which is chamfered and then welded together by two semimonocoques/shells to form a hollow space through which the cooling liquid, including cooling water, a suitable oil or a cooling liquid to which specific components have been added, may flow. The surface may be manufactured from Hardox as it is much harder than regular steel and therefore more resistant to wearing. Hardox is however more sensible to temperature changes and becomes soft at temperatures of approx. 280°. Said grill plates from steel are rather expensive to manufacture and welding of the two shells is risky. Welding is carried out in a bain-marie to prevent hardness deterioration of the Hardox material and to continuously dissipate heat from the welding point as the temperature of Hardox should not reach approx. 280°, Hardox remaining only hard up to said temperature. After welding, the grill plate requires an operation of dressing as it inevitably undergoes distortion from the fact that welding leads to high temperatures in limited local areas and the plate interior is subjected to high temperature gradients.

As shown in DE 196 13 507 C1, the points on the upper sides of the grill plates where the cascade-type overlapping grill plates are in contact and wearing is the result of their advance motion, are provided with separate wear plates. The latter may be replaced in case of need so that the base structure of the grill plate may be used further. In DE 196 13 507 C1, the wear plates have been directly placed on to the base structure by welding them to it.

U.S. Pat. No. 6,266,883 also shows a solution where the grill plate includes a rather thin support plate functioning as a wear plate, which is by preference fixed to the grill plate by welding it along its edges, thus forming a highly-wear-resistant surface. The material given for said wear plates is rolled steel of an especially wear-resistant alloy which is subsequently hardened by tempering or coated with a specifically hard surface layer. It is said that said steel is allegedly commercially available, but only so far for special machinery construction and not in the context of grill plates.

The above solutions have made use of the wear plates by positioning them directly to the cooled grill plates. From a macroscopic view, these wear plates make full contact with the cooled grill plates, but it is evident that heat transfer from the wear plate to the cooled grill plate is highly limited. This results in a low efficiency of liquid cooling taking effect on the cooled grill plate underneath. As, from the microscopic view, the lower side of the wear plates, on the one hand, as well as the upper sides of the cooled grill plates are uneven, on the other hand, there are many small air gaps, and the plates actually only make contact with each other at some few points or at minor raised parts when examined by microscope; they only have full contact at these points, and efficient heat transfer is only possible there, whereas at all other places the air gaps have an insulating effect.

It is therefore the object of the present invention to provide a liquid-cooled grill made of grill plates and planks which can be manufactured from cheap iron or steel which is temperature-insensitive, but which have the required wear-resistance by being equipped with exchangeable wear plates, and which, at the same time, allow for a substantially improved heat transfer form the wear plate to the liquid-cooled grill plate or plank so that the cooling effect is hardly limited, although the wear plate is positioned.

Said object has been met by a liquid-cooled grill consisting of several grill plates through which a liquid is flowing, and lateral planks, the surfaces of which are provided each with one or more wear plates connected to the liquid-cooled grill plates and/or lateral plank in a heat-conducting manner, wherein said grill is provided with a highly heat-conducting film which is clamped between the wear plates and the liquid-cooled grill plates and lateral planks to allow for heat transfer from the wear plates and the liquid-cooled grill plates and lateral planks and the wear plates are connected in a removable way with the liquid-cooled grill plates and lateral planks.

The details of the invention are further described in the drawing, explaining its function.

Figure 2:
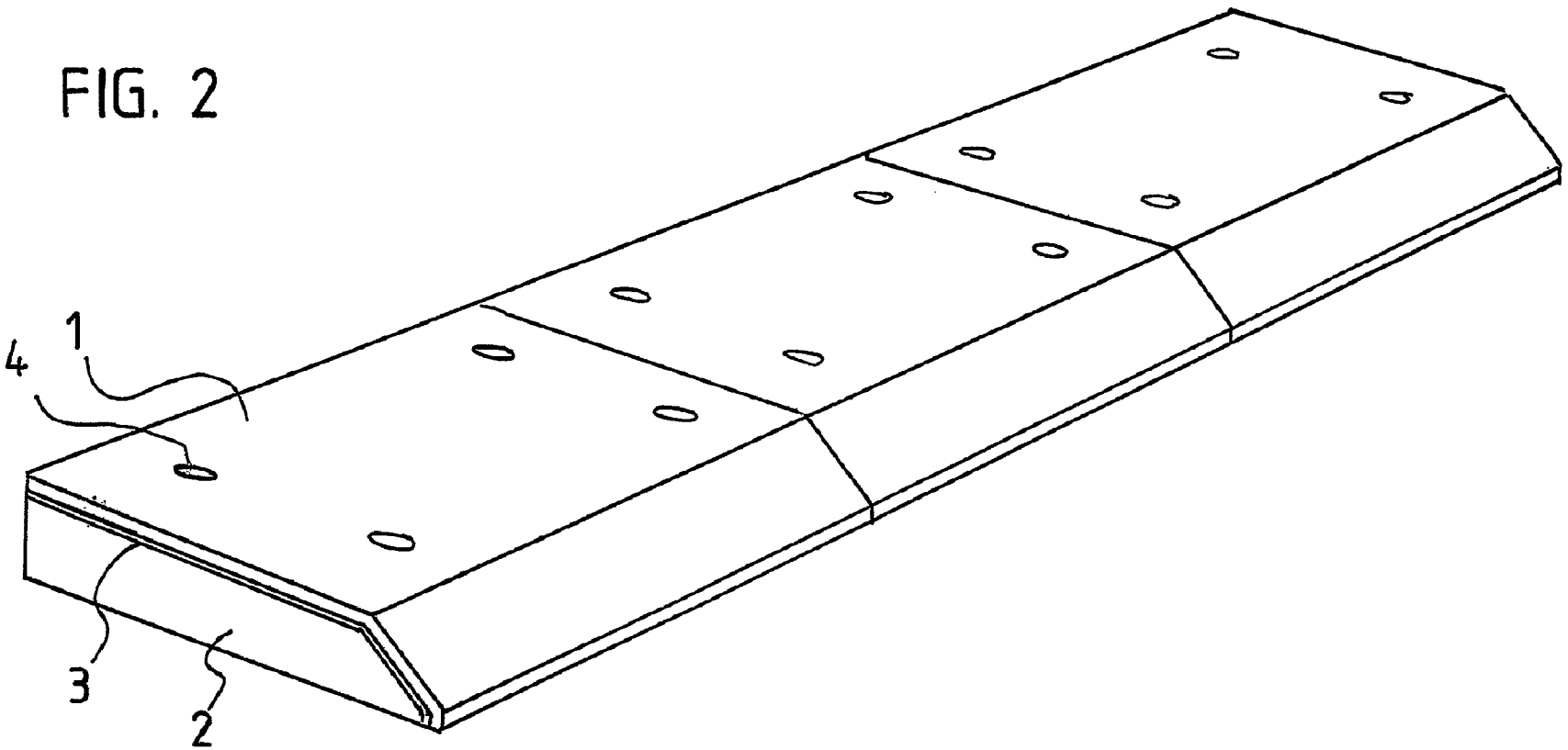
Figure 3:
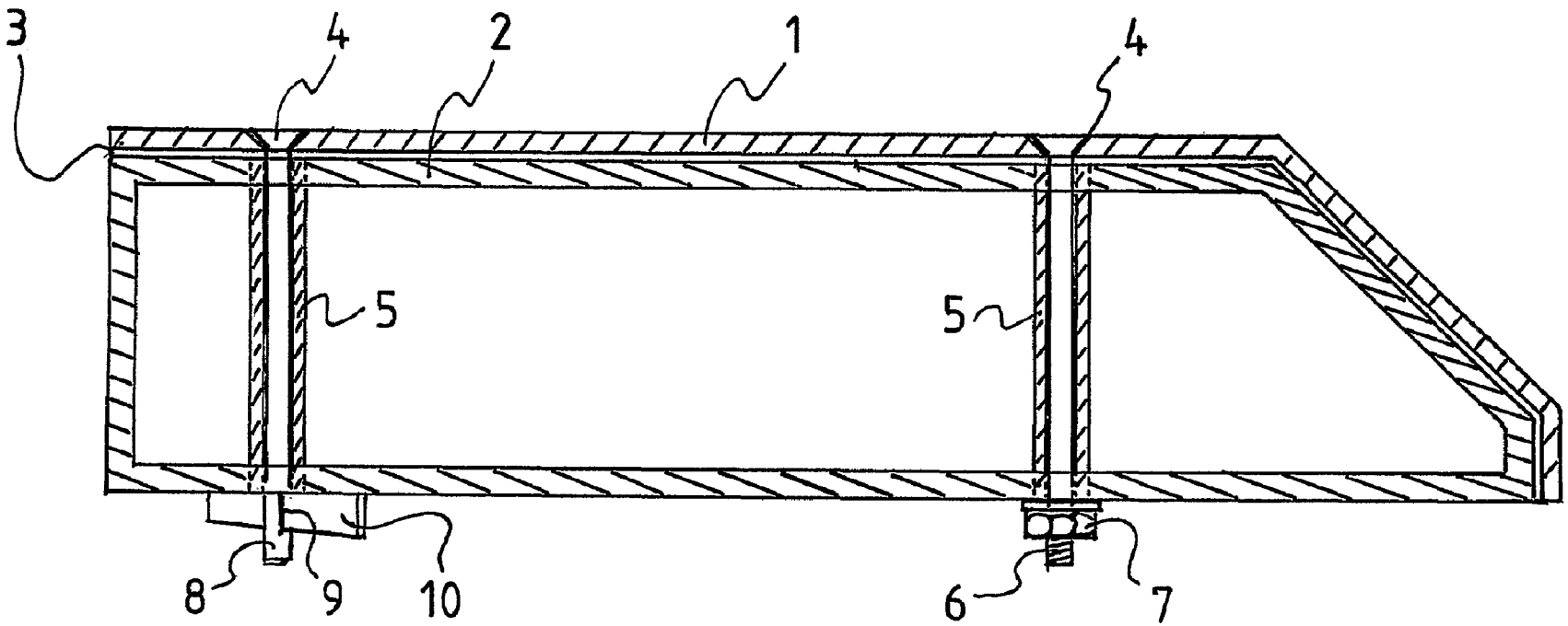
Figure 4:
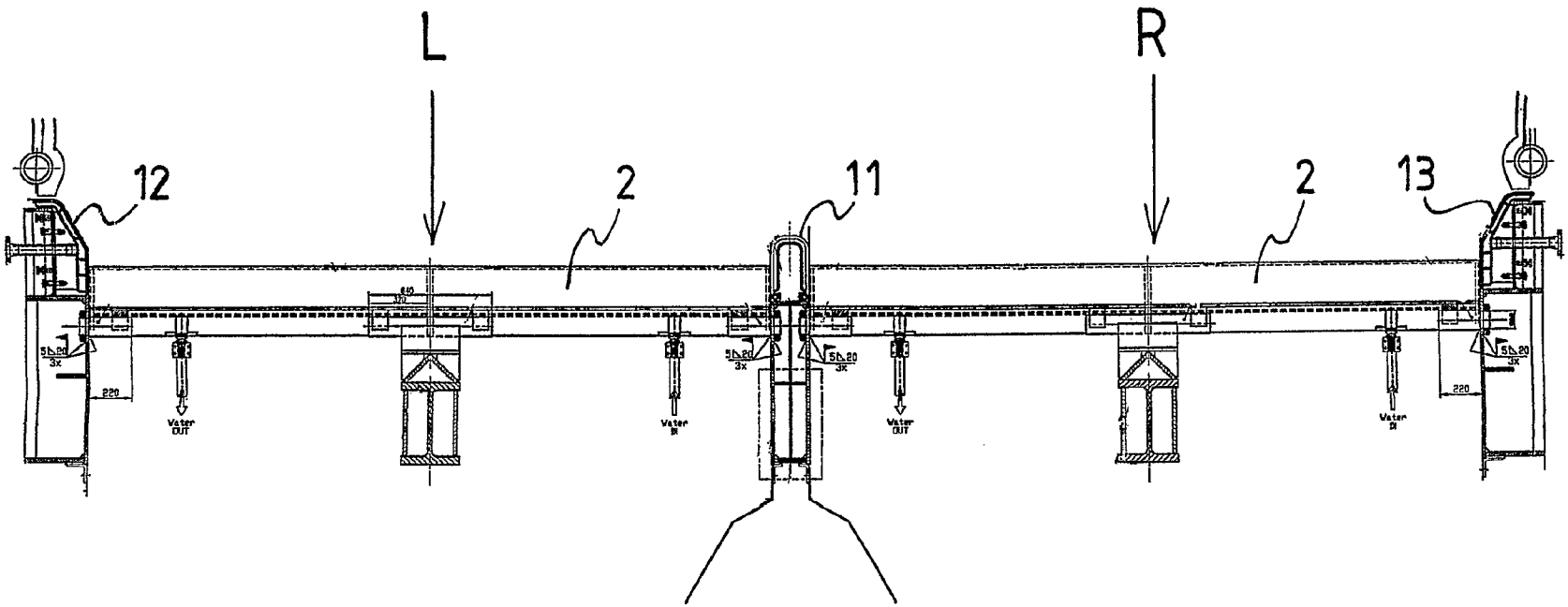
Figure 5:
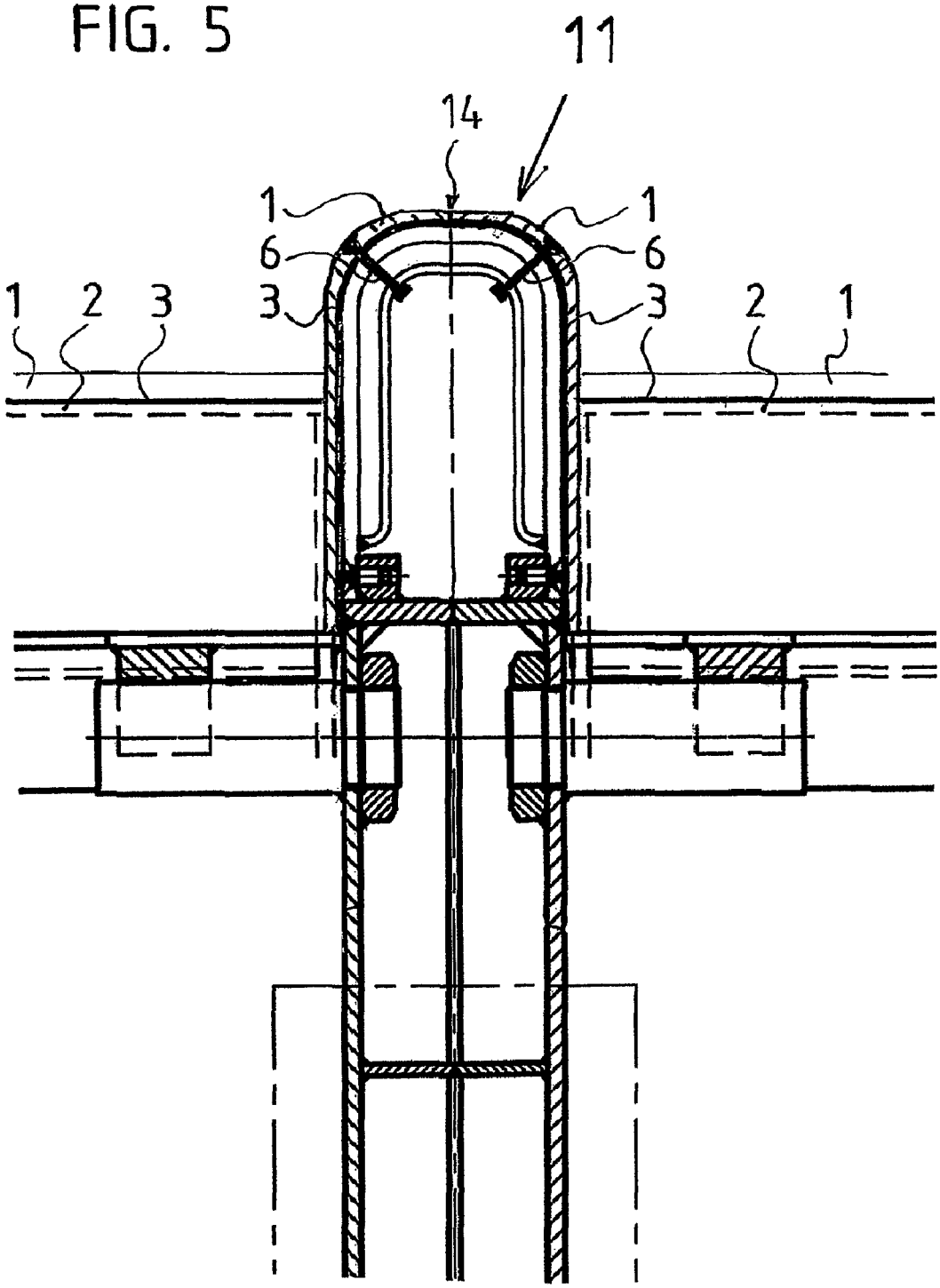
Figure 6:
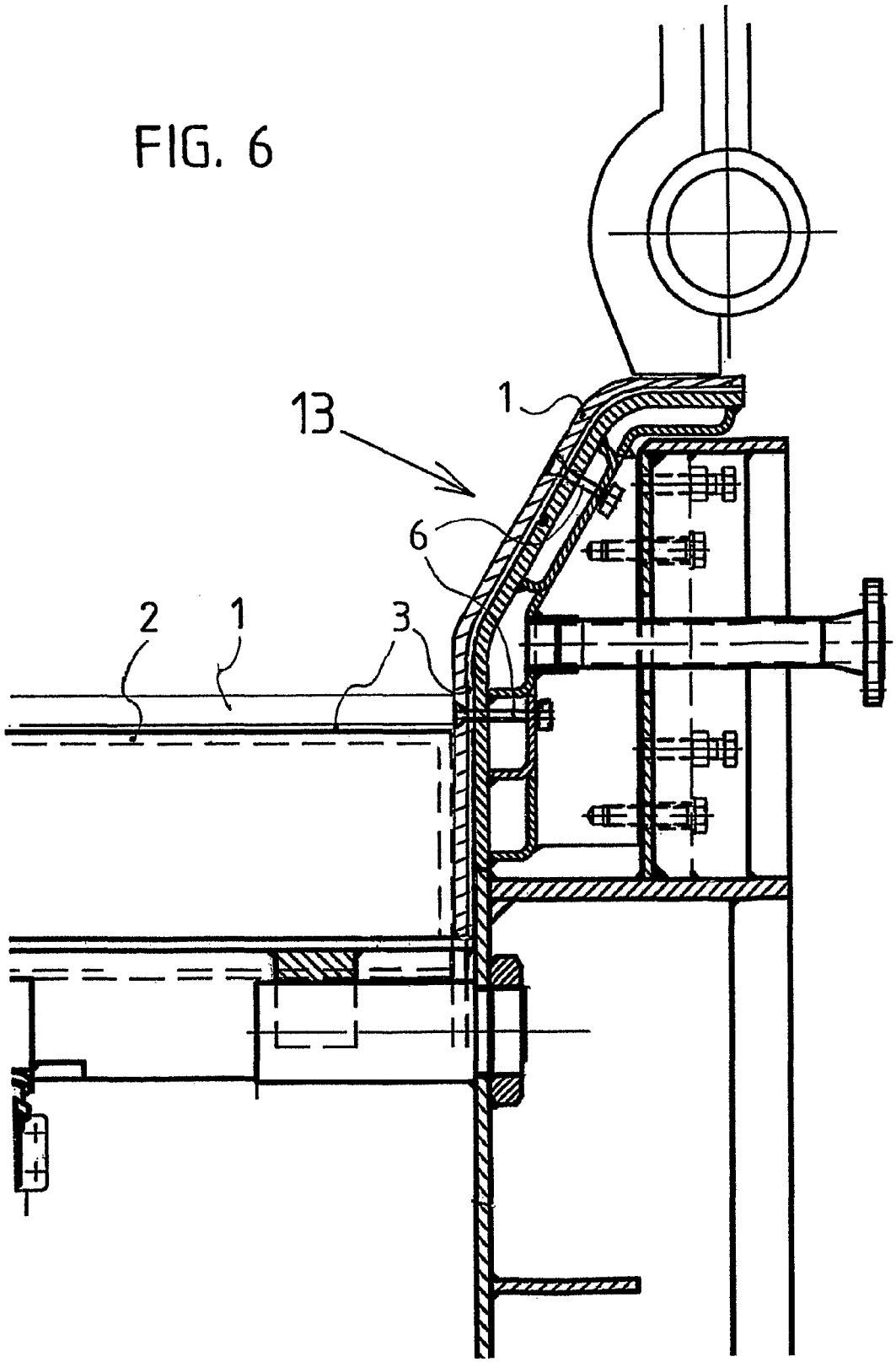

The figures show the following objects:

FIG. 1: A single grill plate of the grill including a wear plate and a heat-conducting interim layer in exploded view, the three components being shown separately from each other;

FIG. 2: A single grill plate of the grill including two wear plates placed next to each other and a heat-conducting interim layer in exploded view;

FIG. 3: A single grill plate of the grill including a wear plate in diagrammatic cross-section;

FIG. 4: A diagrammatic section across a liquid-cooled grill including two grill sections;

FIG. 5: The central planks between two grill sections, in an enlarged cross-section view;

FIG. 6: One of the lateral planks of the grill section, in an enlarged cross-section view.

Said liquid-cooled grill plate with a separate wear plate used for the design of said liquid-cooled grill is generally identical with a conventional one, except for the fact that the construction material is not necessarily quenched and subsequently drawn steel, but iron, structural steel, cast iron or any combination of them, for instance. Said liquid-cooled grill plate shown in FIG. 1 therefore forms a body 2 through which a medium can flow, for example by designing it as a hollow body, with a feed and discharge pipe for the cooling liquid. Said cooling liquid will mainly be water, but it may also be oil, or oil or water containing specific additives. The plate is manufactured by welding together two shells which encompass a hollow space for instance. Such welding needs not be done in a bain-marie as the steels used are resistant to higher temperatures without problems. The fear of distortion is also much lower due to the specific properties of the steels used as material. The body 2 through which media can flow may consist of a solid plate provided with suitable holes drilled through it or hollow spaces in it.

To provide said plate with the required wear resistance, its surface should be considerably harder than any normal structural steel. The solution offered is to equip the upper side of the grill plate with at least a separate wear plate 1 where it makes contact with the combustion material. The material used for said wear plate 1 may be any material which is sufficiently hard, has some mechanical strength and can be maintained, by cooling it through the underlying plate, at a temperature which does not endanger its hardness. Hardox steel, for instance, is particularly suitable for the construction of the wear plates. What is most significant is that said wear plate 1 is brought into contact with body 2 through which fluids can flow in a way that allows for optimum heat transfer. For example, a wear plate 1 of a thickness of 5-10 mm is placed on body 2 through which fluids can flow, and is bolted, riveted, clamped or glued to the latter in a positive or non-positive form. The wear plate is provided with holes 4 for this purpose so that the bolt heads are flush to the surface of the wear plate. To ensure good heat transfer from plate 1 to the liquid-cooled steel construction 2, a suitable heat-conducting material 3 is inserted and held in a clamped position between wear plate 1 and the liquid-cooled body 2. The purpose of this material 3 is the compensation of a possible unevenness and a full-contact and intimate mechanical connection and heat conduct between plates 1 & 2. Excellent heat-conducting materials are for example so-called highly thermoconducting soft silicone foils. These soft silicone foils have extraordinary elasticity due to their fill of thermoconducting ceramic materials. They are especially suited to dissipate heat from two coupling pieces to a casing or a cooling body across a longer distance due to different tolerances and uneven areas. All advantages of silicone as a basic material can be used here, including high temperature-resistance, chemical strength and high dielectric strength, although the latter is not the property particularly wanted in the present application.

Soft silicone foils are capable of being highly compressed, thus optimally connecting heat sources and heat sinks showing large numbers of uneven areas and tolerances from a thermal view. The excellent form-adapting properties of silicone will enlarge the areas of contact and substantially improves thermal connection. The compression to be applied is rather low, and the extremely high elasticity of the foils will add some mechanical absorption properties. Said soft silicone foils have been used for their thermal qualities as ideal thermal solutions for integration into electronic components on SMD printed circuit boards. Said soft silicone foils are a means to strongly reduce the total thermal contact resistance between two materials. Such soft silicone foils have been supplied, for instance, by Kunze Folien GmbH, Raiffeisenallee 12a, D-82041 Oberhaching (www.heatmanagement-.com) where they are available as KU-TDFD highly thermoconducting soft silicone foils. They are available in several thicknesses. 0.5 mm, 1 mm, 2 mm and 3 mm. Thermal conductivity of these foil materials is 2.5 W/mK, and the foils can be used in a temperature range from −60° C. to +180° C. It is therefore possible to use them between the wear plates of a waste combustion grill and its cooled grill plate body, as the cooled grill plates will always maintain temperatures lower than 50° C.

One of the most important issues for the use of hard wear plates 1 is that their thermal stress-resistance will not be exceeded, and that you can achieve this by cooling them down by liquids inside hollow iron plate 2 with operating temperatures around 50° C. It is therefore necessary to ensure sufficient heat dissipation from the Hardox wear plate 1 to iron plate 2. This will be possible now by inserting a soft silicone foil, as described above, between the wear plate and the cooled grate, which is illustrated in FIG. 1. The soft silicone foil 3 is placed on grate 2 and wear plate 1 is placed on top. Wear plate 1 is chamfered on its front side and will encompass the entire upper and front side of grate 2 which are facing the material to be incinerated.

FIG. 2 shows a grate with three separate wear plates which are arranged next to each other in a way to make full contact with each other, thus forming one single, continuous grill surface, except for the remaining joints between them. It is advisable to subdivide the wear plate in several items in case of larger grill surfaces, which also facilitates their assembly to and removal from the grill, the individual pieces of wear plates having less weight.

Wear plate is braced with grill plate 2, as you can see in FIG. 3, for instance. You can use screw connections for said bracing. In this figure, you see several holes 4 with countersunk head openings in the wear plate. The cooled grill plate has holes with identical alignment. They can be manufactured by welding tins 5 into the shells which will encompass the half-shell surface in a sealing manner. Then you weld the shells together, afterwards welding the tins 5, with their ends engaging into the holes 4 in the shell, in a sealing manner to the shell surface. You now screw the wear plates and the cooled grill plate 2 together, inserting a soft silicone foil with appropriate holes between them. As shown in the right-hand figure, you plug countersunk/flat screws 6 through the wear plate 1 from above, passing them through soft silicone foil 2 and the tins 5 in the grill plates 2, then fastening them from below the grill plate 2 with a counter-nut 7. This will solidly brace wear plate 1 down at several points in the direction of grill plate 2, also clamping the soft silicone foil with full contact and positive fit, thus ensuring optimum heat transfer. Tests have proven that heat transfer will be improved up to five times than without the insertion of such a soft silicone foil. You may rivet the wear plates down as an alternate means to screw connections, or you can use bolts 8 with countersunk heads instead of screws as in the figure on the left, these bolts 8 having a cross slit 9 in their end sections so that you only need a hammer to knock a wedge 10 into this slit 9 from the side. You can undo the connection by simply knocking with a hammer to the counter-side of wedge 10, which will be much easier and faster than unscrewing a large counter-nut.

You can also use sheet copper instead of silicone foils or soft silicone foils. Copper is a soft material and has good thermal conductivity properties. It is in a similar way suitable for being clamped between the water-cooled grill plates and the wear plates braced to them, and due to its softness it clings well to the contours of wear plate and grill plate. All of the above applies in the same way to the equipment of lateral planks of a water-cooled grate. Said lateral planks have been manufactured from water-cooled hollow bodies to date.

FIG. 4 shows a cross section through a liquid-cooled grill with two grill sections R (=right-hand) and L (=left-hand). The two grill sections R and L are separated from a central plank 11 which is used as a stir-up plank both for the R section and the L section. There are side planks 12, 13 at the extreme edges of the grill. The grill plates 2 are manufactured, at least every second one, in a moveable way and will glide to and from in a vertical direction referring to the drawing sheet plane, along the central plank 11 and side planks 12, 13. This results in the wearing of said side planks 12, 13 and central plank 11. An elegant solution of this problem, without deteriorating the desired heat dissipation effect too much, is the use of wear plates on their surface, these wear plates being braced to planks 11, 12, 13 clamping a soft thermoconducting foil between at the same time. In order to revise such a grate equipped with wear plates you only have to replace the latter ones, which is done faster and with reduced costs than replacing all of the grill plates 2 and planks 11, 12, 13. The liquid-cooled grill is equipped with exchangeable wear plates in all areas which will make contact with the incinerated material, and wherever it is subjected to wearing due to sliding friction. At the same time, the cooling effect is hardly deteriorated thanks to liquid cooling so that all advantages will be maintained in all cases.

FIG. 5 shows the central plank 11 from FIG. 4 in an enlarged drawing. Wear plates 1 consist of two sections here, which are joined in the middle at a point 14. They are locked to plank 11 from both sides with flat screws 6, clamping beneath them an inserted thermoconducting foil 3. The lower part contains the cooled grill plates 2, which also bear wear plates on their upper sides, and which make full contact with central plank 11.

FIG. 6 shows one lateral plank 13 from FIG. 4 in an enlarged drawing. Wear plate 1 has been wrapped around plank 13 in one single piece. It clamps beneath it a thermoconducting foil 3, and it is bolted down to plank 13 with two flat screws 6. In the lower area of wear plate 1, there are the cooled grill plates 2, which also bear wear plates on their upper sides, and which make full contact with wear plate 1.

The advantages of said grill structure with separately positioned wear plate 1 and soft thermoconducting foil, e.g. a soft silicone foil or sheet copper for heat transfer, are the following: For maintenance purposes, it is no longer necessary to remove and replace the individual grill plates or grill steps, but you will only replace the wear plates 1 on the grill plates and on their laterally bordering planks 11, 12, 13 clamping, which therefore remain in the plant at all times. The grill plates 2 and planks 11, 12, 13 made of iron can have life cycles of many years, even many decades, regarding their operating temperature of 50° C. and absence of mechanical wearing. If you only have to replace one wear plate 1 of a grill plate, this will cost you a fracture of the costs of an entire conventional hollow grill plate. A single wear plate 1 can also be replaced much faster than a complete grill plate. If you have to replace the entire grill plate, the cooling circuit has to be interrupted, and the cooling fluid in the plates has to be discharged. You only can then lift the individual grill plates out of the grate, using lifting gear, which is a rather expensive operation. You will have to manufacture some replacement plates through a rather expensive production process. The fact that you only have to replace wear plates 1 avoids the discharge of the liquid-cooled grill for instance. You only have to unscrew the nuts in the base of the grill plate and lift the wear plates off the grill and change them. You insert new flat screws and brace the new wear plates to the grill plates again. The same is to be done with the lateral liquid-cooled planks of the grate. Replacing the wear plates 1 is therefore by many times faster done than replacing entire grill steps, and the manufacturing of new liquid-cooled grill plates which had to be included in practice to date, can be totally omitted. You also benefit from a much better heat dissipation when you insert thermoconducting foils. The heat can be dissipated from the grill surface, i.e. from the wear plates, in a uniform way everywhere, and said wear plates will remain largely uniformly hot over their entire surface. The advantages of the structural design as presented in this invention are therefore highly obvious.

The invention claimed is:

1. Liquid-cooled grill/grate consisting of several liquid-cooled grill plates (2) through which fluids can flow, and lateral planks (11, 12, 13) the surfaces of which are provided with one or more wear plates (1) connected to the liquid-cooled grill plates (2) and/or the lateral planks (11, 12, 13) in a heat-conducting manner, wherein heat transfer from the wear plates (1) both to the liquid-cooled grill plates (2) and lateral planks (11, 12 ,13) is achieved by clamping a highly heat-conducting foil between the wear plates (1) and the liquid-cooled grill plates (2) and lateral planks (11, 12, 13), the wear plates (1) being connected to the liquid-cooled grill plates (2) and lateral planks (11,12,13) in a detachable way.

2. Liquid-cooled grill according to claim 1, wherein the highly heat-conducting foil (3) is mainly made of silicone.

3. Liquid-cooled grill according to claim 1, wherein the highly heat-conducting foil (3) is soft silicone foil (3).

4. Liquid-cooled grill according to claim 1, wherein the highly heat-conducting foil (3) is sheet copper.

5. Liquid-cooled grill according to any of the preceding claims, wherein its surfaces are equipped with wear plates (1) which are connected to the liquid-cooled grill plates (2) located underneath them and lateral planks (11, 12, 13) in a heat-conducting manner, which is achieved by clamping the highly heat-conducting foil (3) between.

6. Liquid-cooled grill according to any of the preceding claims, wherein the surfaces of the grill plates (2) and lateral planks (11, 12, 13) are provided with wear plates (1), the latter being bolting to the grill plates (2) and/or lateral planks (11, 12, 13) using screw connections (6, 7).

7. Liquid-cooled grill according to any of the claims 1 to 6, wherein the surfaces of the grill plates (2) and lateral planks (11, 12, 13) are provided with wear plates (1), the latter being bolting to the grill plates (2) and/or lateral planks (11, 12, 13) using rivets.

8. Liquid-cooled grill according to any of the claims 1 to 5, wherein the surfaces of the grill plates (2) and lateral planks (11, 12, 13) are provided with wear plates (1), the latter being connected to the grill plates (2) and/or lateral planks (11, 12, 13) using clamping joints (8-10).

* * * * *